US006681447B2

(12) United States Patent
Houk, Jr. et al.

(10) Patent No.: US 6,681,447 B2
(45) Date of Patent: Jan. 27, 2004

(54) HINGE ASSEMBLY FOR A STORAGE ENCLOSURE

(75) Inventors: David Anthony Houk, Jr., Norton, OH (US); Timothy Michael Pierzynski, Wooster, OH (US); Wendell R. Conn, Polk, OH (US)

(73) Assignee: Rubbermaid Incorporated, Wooster, OH (US)

( * ) Notice: Subject to any disclaimer, the term of this patent is extended or adjusted under 35 U.S.C. 154(b) by 53 days.

(21) Appl. No.: 10/042,837

(22) Filed: Jan. 9, 2002

(65) Prior Publication Data

US 2002/0092128 A1 Jul. 18, 2002

Related U.S. Application Data

(60) Provisional application No. 60/261,394, filed on Jan. 12, 2001.

(51) Int. Cl.[7] ..... E05D 1/06

(52) U.S. Cl. ..... 16/268; 16/260; 16/360

(58) Field of Search ..... 16/268, 260, 261, 16/270, 292, 223, 227, 252, 360, 392, 259, 263, 272

(56) References Cited

U.S. PATENT DOCUMENTS 1,505,029 A * 8/1924 Kellerman ..... 16/270
4,697,306 A * 10/1987 Rhodes ..... 16/317
5,075,928 A * 12/1991 Bobrowski ..... 16/273
5,265,495 A * 11/1993 Bung et al. ..... 74/502.6
5,518,332 A * 5/1996 Katoh ..... 403/155
5,915,441 A * 6/1999 Schlack ..... 16/371
6,030,064 A * 2/2000 Kim ..... 312/405
6,141,830 A * 11/2000 Shimooka ..... 16/237
6,302,382 B2 * 10/2001 Santelli, Jr. ..... 256/25

* cited by examiner

*Primary Examiner*—Gary Estremsky
*Assistant Examiner*—Mark Williams
(74) *Attorney, Agent, or Firm*—Marshall, Gerstein & Borun LLP

(57) ABSTRACT

A hinge assembly for a storage enclosure is disclosed. The hinge assembly includes a base and a pair of pivot mounts. The base includes a pivot member, and the pair of pivot mounts include a male/female interface. The male/female interface is configured to connect the pair of pivot mounts and to couple the pair of pivot mounts to the retaining member. The male/female interface may be provided by a hook member inserted through a slot and pivoted to engage the wall that defines the slot. One pivot mounts includes a groove, and the other pivot mount includes a ramped lug that engages the groove in a snap-in engagement to provide resistance to movement when the pivot mounts are aligned.

19 Claims, 10 Drawing Sheets

HINGE ASSEMBLY FOR A STORAGE ENCLOSURE

CROSS-REFERENCE TO RELATED APPLICATIONS

The present invention claims priority under 35 U.S.C. §119 from U.S. Provisional Patent Application No. 60/261,394 titled "HINGE ASSEMBLY" filed Jan. 12, 2001, the full disclosure of which is hereby incorporated by reference.

FIELD OF THE INVENTION

The present invention relates to a door hinge for storage units or enclosures such as cabinets or sheds. More particularly, the invention pertains to multiple component hinges made of plastic.

BACKGROUND OF THE INVENTION

It is generally known to provide for a hinge assembly for outdoor and indoor storage enclosures such as cabinets, sheds, and the like. These storage enclosures can be found in residences as well as commercial establishments. Such hinge assemblies for storage enclosures are typically attached to a frame or wall are configured to allow open and closure (vertically, horizontally, etc.) of a door, panel, or the like. Materials used for these storage units and for doors include wood, metal, plastic, etc. When plastic is used, metal hardware is typically used for the doors. Other known hinge assemblies can include a post and socket attachment.

However, such known hinge assemblies have several disadvantages including an inability to allow the door to fully open (e.g., door pivots to a position that is flush or approximately flush with adjacent walls. Also, such known hinge assemblies typically have multiple component pieces and are complex to manufacture and assemble. Further, a post and socket attachment may limit the door attachment to the top and bottom of the doors, which may cause flexing of an edge of the hinge assembly near the center of the door. This flexing may cause an uneven hinge gap and allow weather (e.g., moisture, air flow, etc.) to enter the storage unit. Additionally, metal hardware expands and contracts at different rates (during temperature changes) than the plastic storage enclosures that it is attached to. Also, such metal hardware may corrode over time, which is unsightly and can cause the hardware to fail. Further, known hinge assemblies are difficult, if not impossible to disassemble to allow removal of the door, panel, or to allow repair, reconfiguration, and the like of the storage enclosure.

Accordingly, it would be advantageous to provide a hinge assembly that includes a pair of pivot mounts that capture a base plate and that may be assembled easily with parts that are few in number and easy to manufacture. To provide an inexpensive, reliable, and widely adaptable hinge assembly that avoids the above-referenced and other problems would represent a significant advance in the art.

SUMMARY OF THE INVENTION

A primary feature of the present invention is to provide an inexpensive, easy-to-manufacture and aesthetically-pleasing hinge assembly that overcomes the above-noted disadvantages.

Another feature of the present invention is to provide a hinge assembly that includes a pair of pivot mounts that capture a base plate and that may be assembled easily and with parts that are few in number and easy to manufacture.

Another feature of the present invention is to provide a hinge assembly that provides a non-corrosive hinge that requires a minimum amount of maintenance.

Another feature of the present invention is to provide a hinge assembly that has a reduced number of component pieces.

Another feature of the present invention is to provide a hinge assembly that is less complex to manufacture (e.g., mold, assemble, etc.).

Another feature of the present invention is to provide a hinge assembly that allows the door to pivot to a fully open position.

Another feature of the present invention is to provide a hinge assembly that provides multiple point fastening that reduces door flexing along the hinge line and maintains a constant hinge gap for the entire door length.

Another feature of the present invention is to provide a hinge assembly that allows the door to pivot about 180 degrees or pivot more than 180 degrees.

Another feature of the present invention is to provide a hinge made of plastic that will support a storage enclosure door along its length, that is corrosion resistant, that expands and contracts with a plastic storage enclosure, and that provides a sight appealing constant width hinge gap along the door length and a hinge edge resistant to flexing.

How these and other advantages and features of the present invention are accomplished (individually, collectively, or in various subcombinations) will be described in the following detailed description of the preferred and other exemplary embodiments, taken in conjunction with the FIGURES. Generally, however, they are accomplished in a hinge assembly which comprises a pair of pivot mounts and a base. The pivot mounts include a male/female interface configured to capture a ring on the base. The interface may include a pair of prongs in one pivot mount that engage a pair of slots in the other pivot mount. Preferably, the interface is positioned in line with an outside surface of the door and the hinge assembly edge. One or more bearing surfaces on the base and the pivot mounts engage to provide rotation.

These and other advantages and features of the present invention may also be accomplished in a hinge assembly for storage units that includes a base, a lower pivot mount, and a upper pivot mount. The base includes a ring with an inside surface which rides around a bearing surface on the lower pivot mount to allow the door to rotate or swing. The lower pivot mount also includes through-slots used for base assembly retention. The upper pivot mount includes protruding prongs that engage the through-slots of the lower pivot mount. The prongs also wedge under a matching surface of the lower pivot mount when the two pivot mounts are pivoted together. The lower pivot mount also includes a protruding ramped lug is on the top base surface. The upper pivot mount includes a slot on the bottom base surface that engages the ramped lug on the lower pivot mount to provide resistance to lateral pivot movement for disassembly.

These and other advantages and features of the present invention may also be accomplished in a hinge assembly for storage units such as cabinets or sheds. The hinge assembly includes a base, a lower pivot mount, and a upper pivot mount. The base is coupled to a door of a storage enclosure. The lower and upper pivot mounts are coupled to a door frame or jamb. The lower pivot mount includes one or more slot. The upper pivot mount includes one or more prongs configured to engage the slots of the lower pivot mount. The pivot mounts rotate about a pivot axis, wherein the pivot axis is configured to allow approximately 180° of rotation.

The present invention further relates to various features and combinations of features shown and described in the disclosed embodiments. Other ways in which the objects and features of the disclosed embodiments are accomplished will be described in the following specification or will become apparent to those skilled in the art after they have read this specification. Such other ways are deemed to fall within the scope of the disclosed embodiments if they fall within the scope of the claims which follow.

DETAILED DESCRIPTION OF PREFERRED AND OTHER EXEMPLARY EMBODIMENTS

Figure 1:
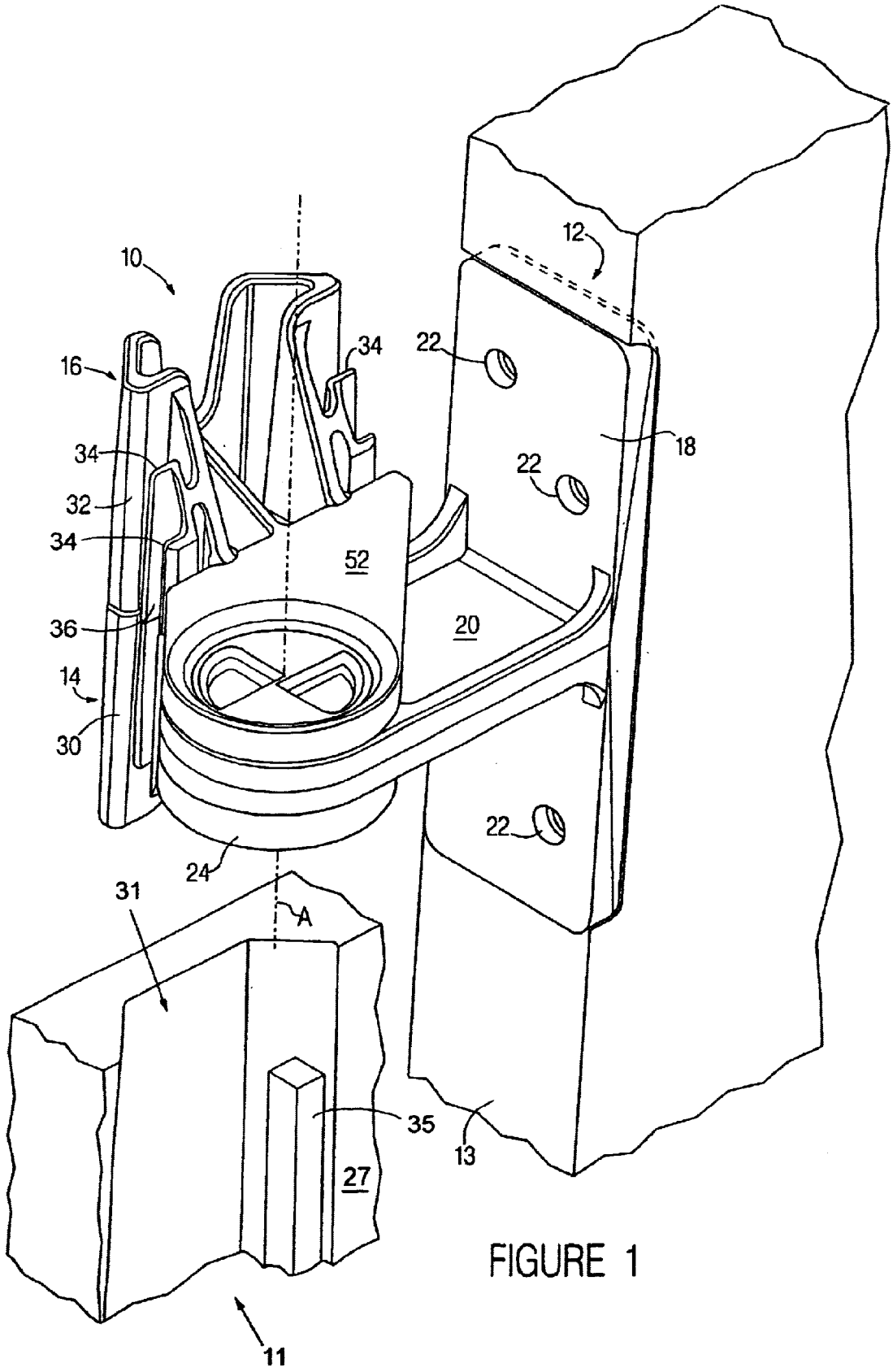
FIG. 1 is a fragmentary perspective view of a hinge assembly for a storage enclosure according to a preferred embodiment.

FIGS. 1–11 show a hinge assembly 10 for a storage enclosure 11 (e.g., shed, cabinet, etc.). Hinge assembly 10 includes a plurality of components that allow a pivot mechanism to be captured between a pair of pivot mounts for positive retention in a vertical orientation (e.g., for a vertical door 13). Before proceeding to the detailed description of the preferred and exemplary embodiments, several comments can be made about the general applicability and the scope thereof.

First, while the components of the disclosed embodiments will be illustrated as a hinge assembly designed for a storage enclosure, the features of the disclosed embodiments have a much wider applicability. For example, the hinge assembly design is adaptable for other storage units, bins, containers, and other office, home, or educational products which employ a hinge configured to rotate relative to a base. Further, the size of the various components and the size of the enclosures can be widely varied.

Second, the particular materials used to construct the exemplary embodiments are also illustrative. For example, injection molded acetal (e.g., Delrin™) is the preferred method and material for making the top and base, but other materials can be used, including other thermoplastic resins such as polypropylene, high density polyethylene, other polyethylenes, acrylonitrile butadiene styrene ("ABS"), polyurethane nylon, any of a variety of homopolymer plastics, co-polymer polypropylene, other copolymer plastics, plastics with special additives, filled plastics, etc. Also, other molding operations may be used to form these components, such as blow molding, rotational molding, etc.

Third, while the hinge assembly is shown in a vertical orientation, the hinge assembly may be configured with a positive retention in any of a variety of orientations according to the desired storage enclosure configuration.

Proceeding now to descriptions of the preferred and exemplary embodiments, FIGS. 1–11 show hinge assembly 10 including a pivot plate or base 12, a lower pivot mount 14, and an upper pivot mount 16. Base 12 includes a mounting plate 18 and a pivot member 20 which extends from mounting plate 18. Mounting plate 18 includes a plurality of holes 22 so that base 12 may be mounted to a flush mounted door or panel 28 by a plurality of fasteners. Alternatively, mounting plate 18 is configured for any of a variety of conventional attachment techniques (e.g., rivets, adhesive, welding, positive locking interface, and the like). Pivot member 20 includes a ring 24 with an inner bearing surface 26 configured to pivotally couple base with lower pivot mount 14 and upper pivot mount 16.

Lower and upper pivot mounts 14, 16 are pivotally coupled to base 12 by capturing ring 24 and are configured to pivot about a pivot axis A. The position of pivot axis A and the configuration of lower and upper pivot mounts 14,16 are configured to define the opening limit of the attached door or panel. According to a preferred embodiment shown in FIG. 1, pivot axis A is substantially aligned with an outside surface 27 of enclosure 11 and with an edge of the door hinge so that door 13 can be opened approximately 180 degrees. According to alternative embodiments, pivot axis A is positionable in any number of locations or orientations according to the desired pivot position and dimensional characteristics of the door and frame.

Figure 2:
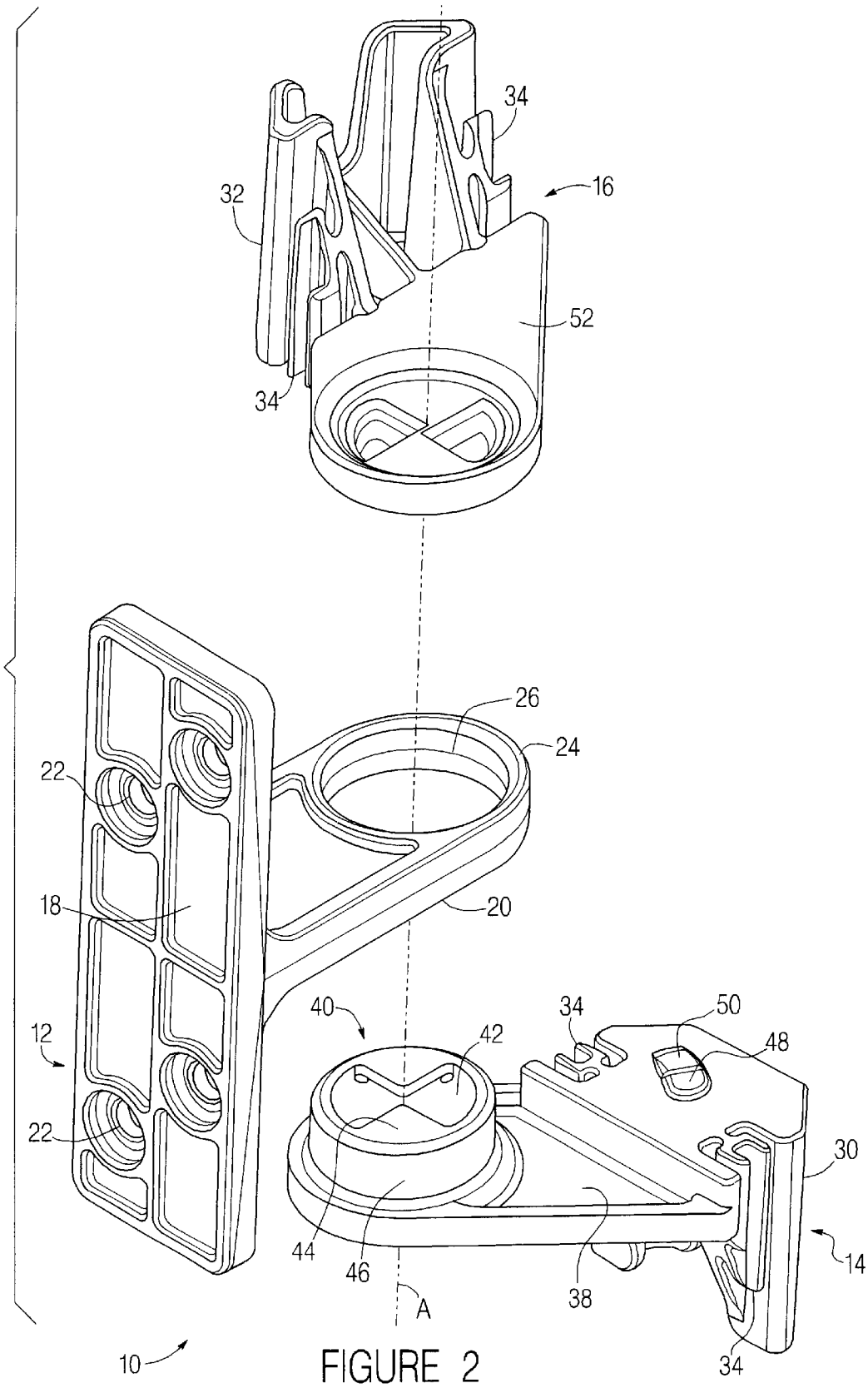
FIG. 2 is an exploded perspective view of the hinge assembly of FIG. 1.
Figure 3:
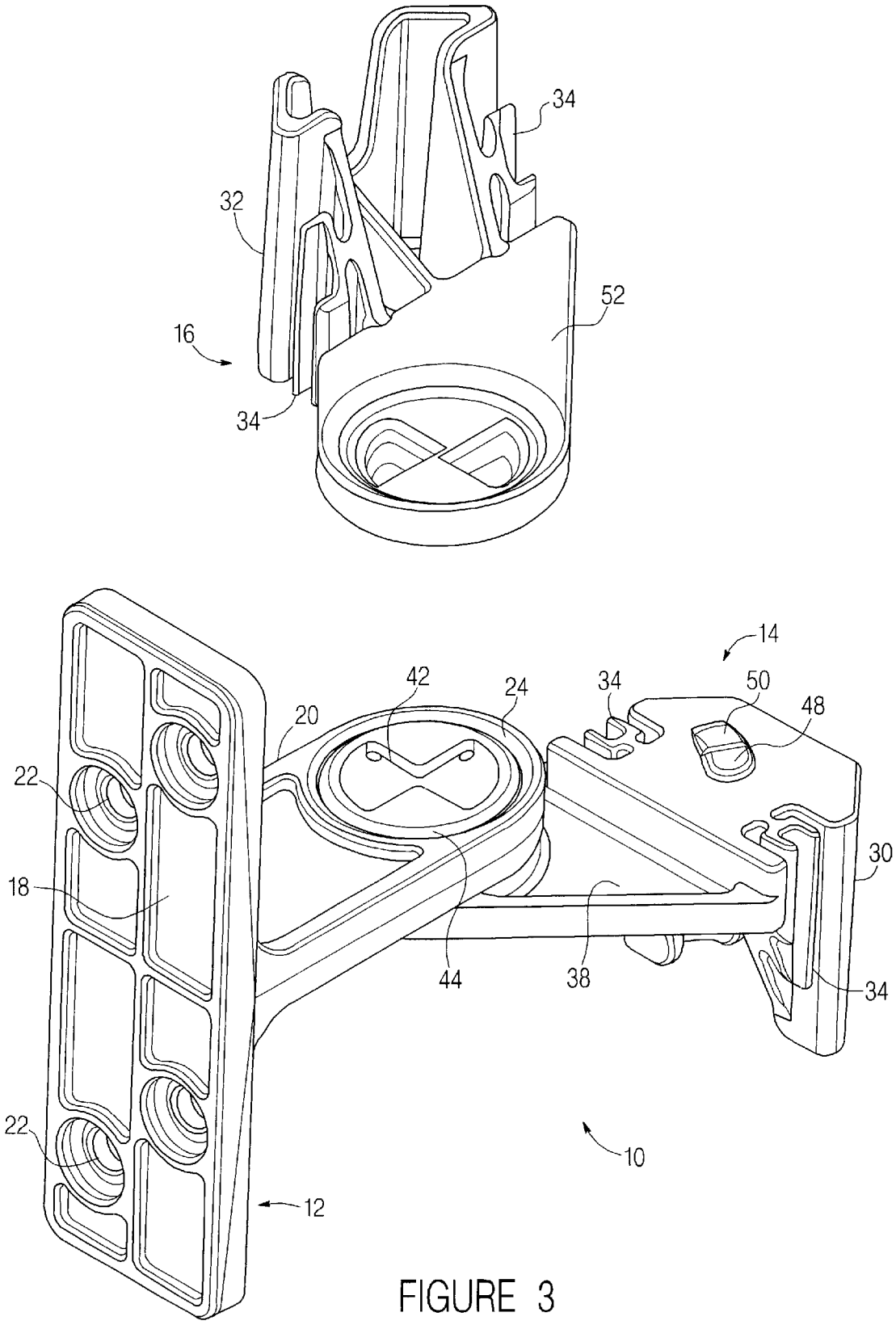
FIG. 3 is a partial exploded perspective view of the hinge assembly of FIG. 1.

Lower pivot mount 14 and upper pivot mount 16 include a lower interface 30 and an upper interface 32, respectively. Lower and upper interfaces 30, 32 are configured to engage grooves 31 in storage enclosure 11 (e.g., frame, wall panel, etc. of the storage enclosure). According to a preferred embodiment, lower and upper interfaces 30, 32 include a series of ribs or fins 34 configured to engage corresponding ribs 35 in storage enclosure 11 when assembled and aligned. As shown in FIGS. 1 and 2, two adjacent fins 34 define a channel 36 therebetween for receiving ribs 35 of storage enclosure 11. According to alternative embodiments, lower and upper interfaces 30, 32 may have any of a variety of configurations, such as integral snaps, fasteners such as screws, clips, or retention slots.

Lower and upper pivot mounts 14, 16 are configured to provide an interlocking interface that captures ring 24, and aligns pivot mounts 14, 16 and lower and upper interfaces 30, 32. As such, the interlocking interface prohibits forces (e.g., static forces or dynamic forces such as those generated during use) to spread the pivot mounts apart (e.g., vertically) which would free the pivot mechanism. According to an alternative embodiment, a biasing member (e.g., a spring, elastomer member, and the like is used to maintain engagement of the interlocking interface.

According to a preferred embodiment shown in FIGS. 1–8, lower pivot mount 14 includes a lower pivot arm 38 that extends from lower interface 30 and provides a "female" pivot interface. Lower pivot arm 38 extends at an angle from lower interface 30 (e.g., for desired opening characteristics of the door) according to the desired pivot axis A position. A cylinder 40 extends from an end of lower pivot arm 38 and provides the "female" interface. Cylinder 40 includes a pair of slots 42 in an upper bearing surface 44 and a side bearing surface 46 configured to engage inner bearing surface 26 of pivot ring 24.

Lower interface 30 includes a protruding lug 48 and a ramp surface 50. Lug 48 is configured to engage a slot 51 (groove, dimple, recess, etc.) in upper interface 32 and is intended to prevent lateral pivoting of pivot mounts 14, 16, intending to prevent self disassembly until positioned and fastened into storage structure 11.

Upper pivot mount 16 includes an upper pivot arm 52 that extends from upper interface 32 and provides a "male" pivot interface. According to a preferred embodiment, upper pivot arm 52 extends at approximately an angle from upper interface 32 (e.g., for desired opening characteristics of the door) according to the desired pivot axis A position. A pair of hook members or prongs 54 extend from a pivot surface 56 on an end of upper pivot arm 52 and provides the "male" interface. Prongs 54 are configured to be inserted into slots 42 in lower pivot arm of lower pivot mount 14. (Alternatively, the "male" and "female" pivot interfaces may be on the other pivot mount).

To engage lower pivot mount 14 and upper pivot mount 16 lower cylinder 40 of lower pivot mount 14 is inserted into ring 24 of base 12. Prongs 54 of upper pivot mount 16 are inserted into slots 42 in lower pivot mount 14. Lower pivot mount 14 and/or upper pivot mount 16 are pivoted (e.g., twisted, turned rotated, etc.) so that prongs 54 engage upper bearing surface 44 of cylinder 40.

After base 12 is placed onto lower pivot mount 14 and prongs 54 of upper pivot mount 16 are inserted through slots 42 in lower pivot mount 14, pivot mounts 14, 16 are rotated so that upper pivot mount prongs 54 are disposed (e.g., "wedged") under the matching surface of lower pivot mount 14 to retain or hold pivot mounts 14, 16 together in a generally aligned direction (e.g., approximately vertical). Rotating lower and upper pivot mounts 14, 16 during assembly also allows a protruding ramped lug 48 on lower pivot mount 14 to engage into a corresponding slot 51 on the mating upper pivot mount surface. Ramp surface 50 allows for lower and upper pivot mounts 14, 16 to spread apart for lug 48 to slide across surface 50 until it can snap down into slot 51 thereby holding pivot mounts 14, 16 together in a lateral direction for aligning the channels 36 and fins 34 of the mounts 14, 16 during assembly to the door frame. The configuration in the area to couple pivot mounts 14, 16 to the frame is preferably determined by the corresponding structure configuration.

Figure 7:
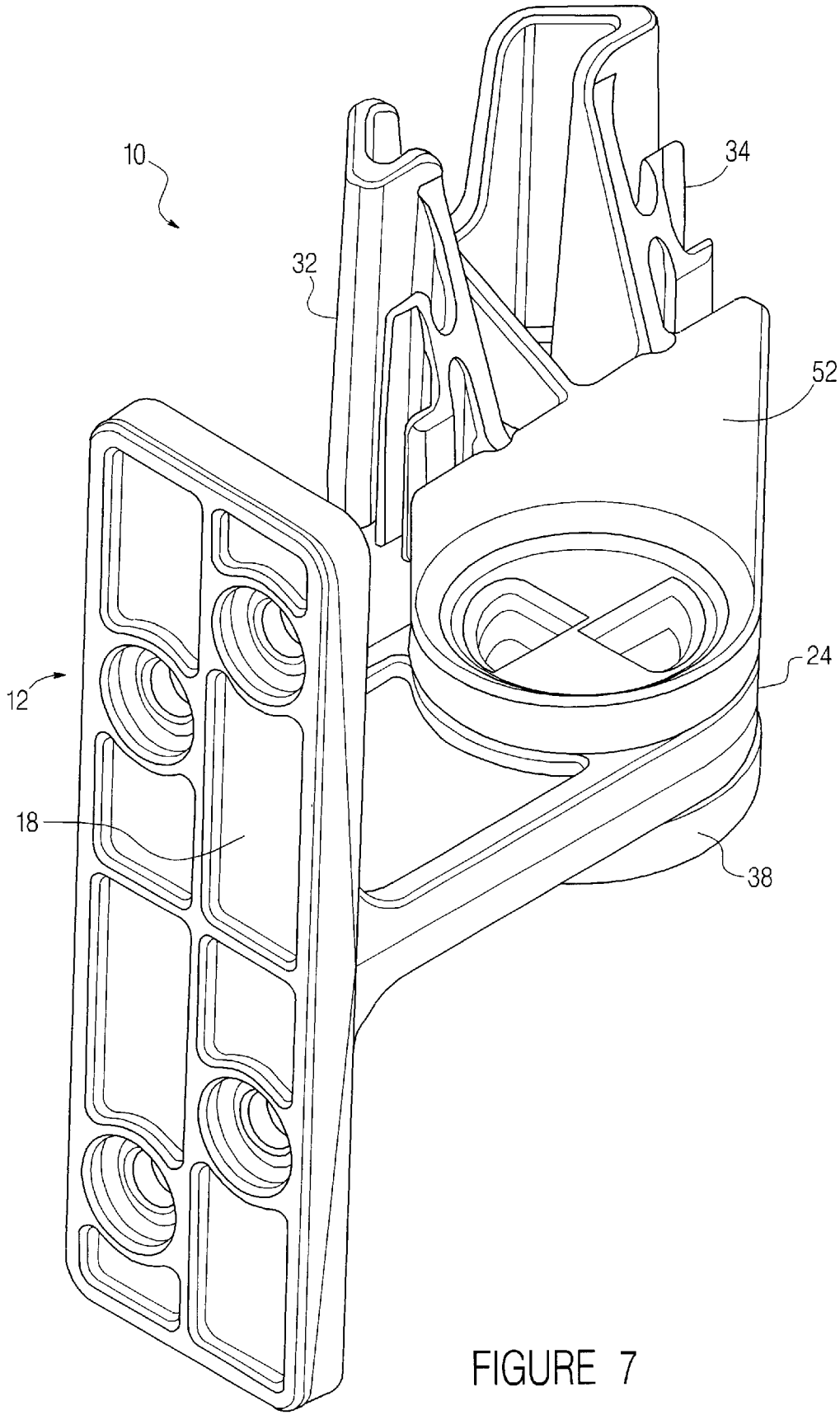
FIG. 7 is a perspective view of the hinge assembly of FIG. 1.

During operation, inner bearing surface 26 of base 12 is configured to ride on upper bearing surface 44 of lower pivot mount 14 and on upper pivot mount 16. As shown in FIG. 7, hinge assembly 10 is ready for assembly with the door and the storage enclosure. According to alternative embodiments, base 12 may be first attached to the storage enclosure and pivot mounts 14, 16 are first coupled to door so that the door is coupled to the storage enclosure by engagement of lower and upper pivot mounts 14, 16.

Figure 4:
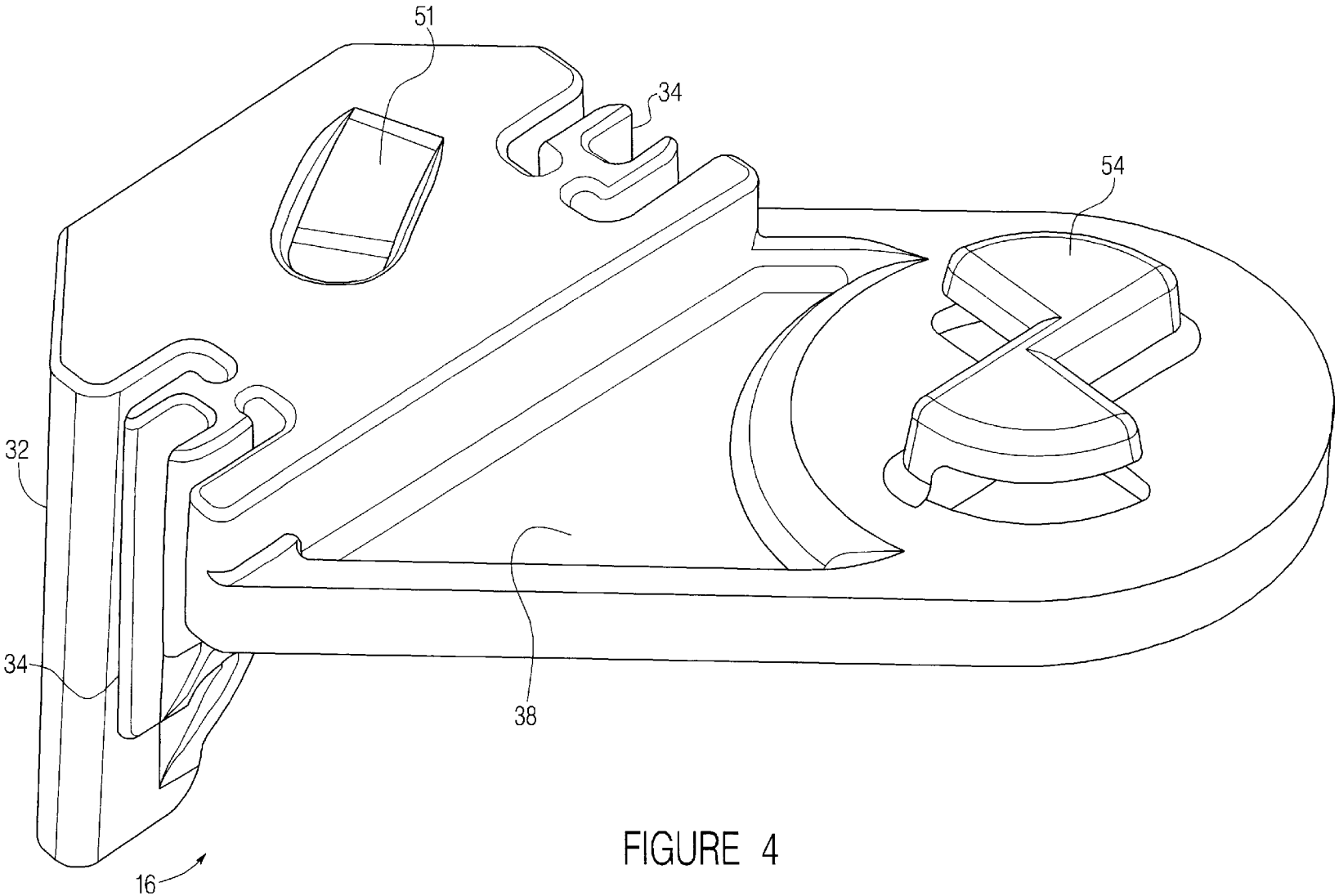
FIG. 4 is a perspective view of an upper pivot mount of the hinge assembly of FIG. 1.
Figure 5:
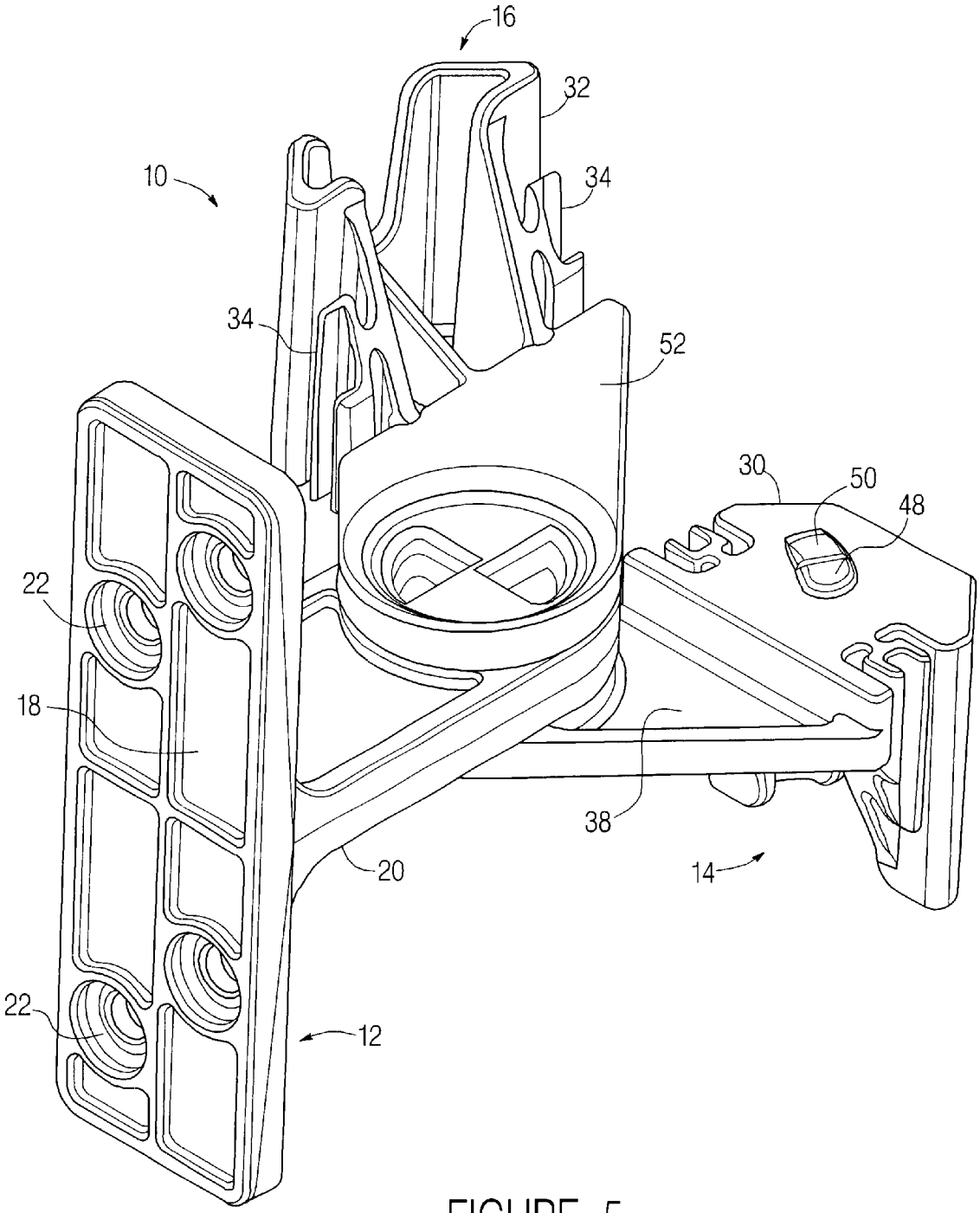
FIG. 5 is a top perspective view of the hinge assembly of FIG. 1.
Figure 6:
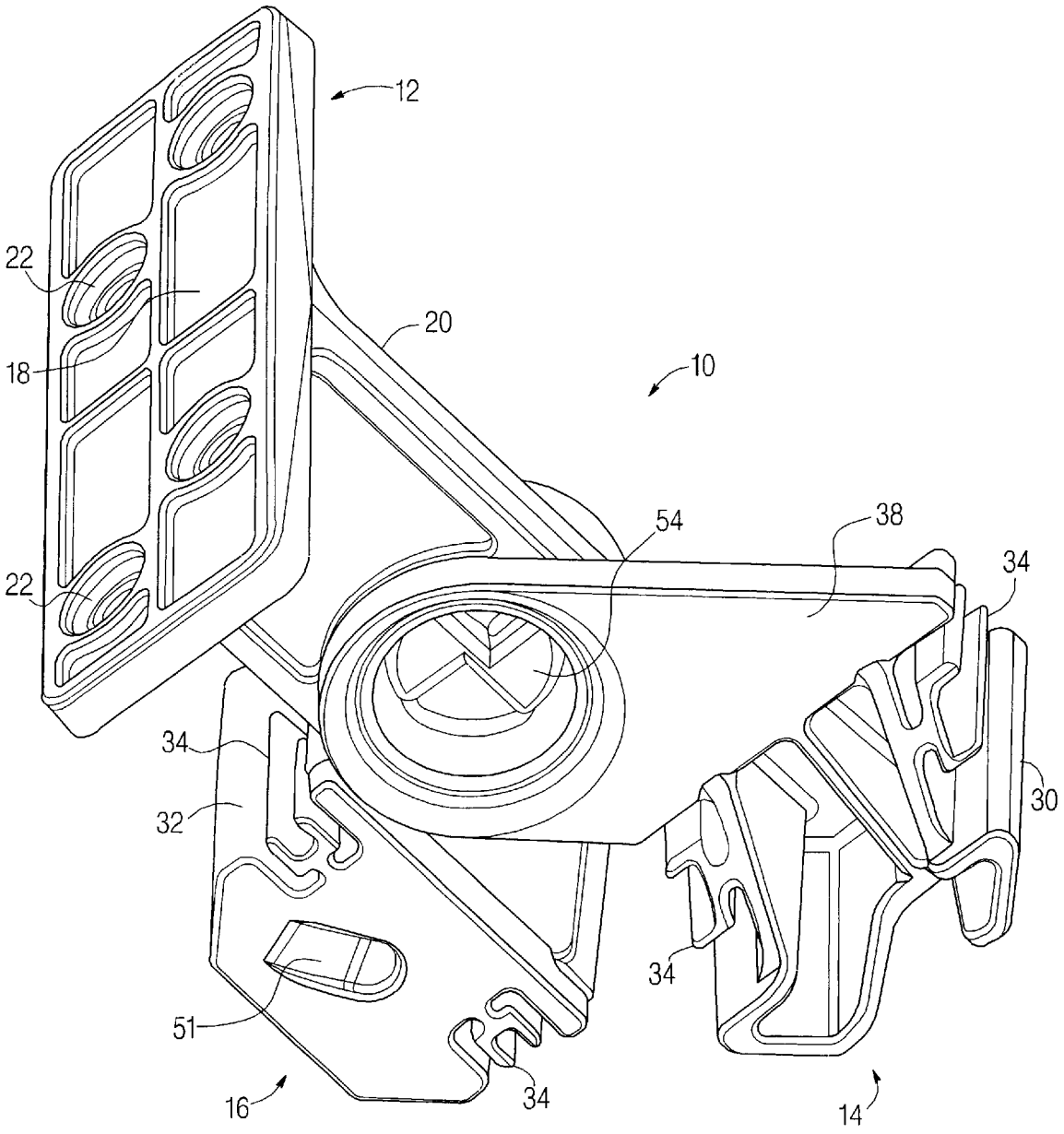
FIG. 6 is a bottom perspective view of the hinge assembly of FIG. 1.

FIG. 4 illustrates a bottom side of upper pivot mount 16 showing prongs 54 and slot 51. FIG. 5 illustrates hinge assembly 10 with upper pivot mount prongs 54 inserted through lower pivot mount 14 through slots 42 before rotating upper pivot mount 16 or lower pivot mount 14. FIG. 6 illustrates the bottom view of hinge assembly 10 with prongs 54 of upper pivot mount 16 inserted through lower pivot mount 14 through slots 42 before rotating upper pivot mount 16 or lower pivot mount 14.

FIG. 7 illustrates hinge assembly 10 for an upright door when in an "open" position—i.e., after hinge assembly 10 has been rotated. Base 12 position is at the approximately 180° door open.

Figure 8:
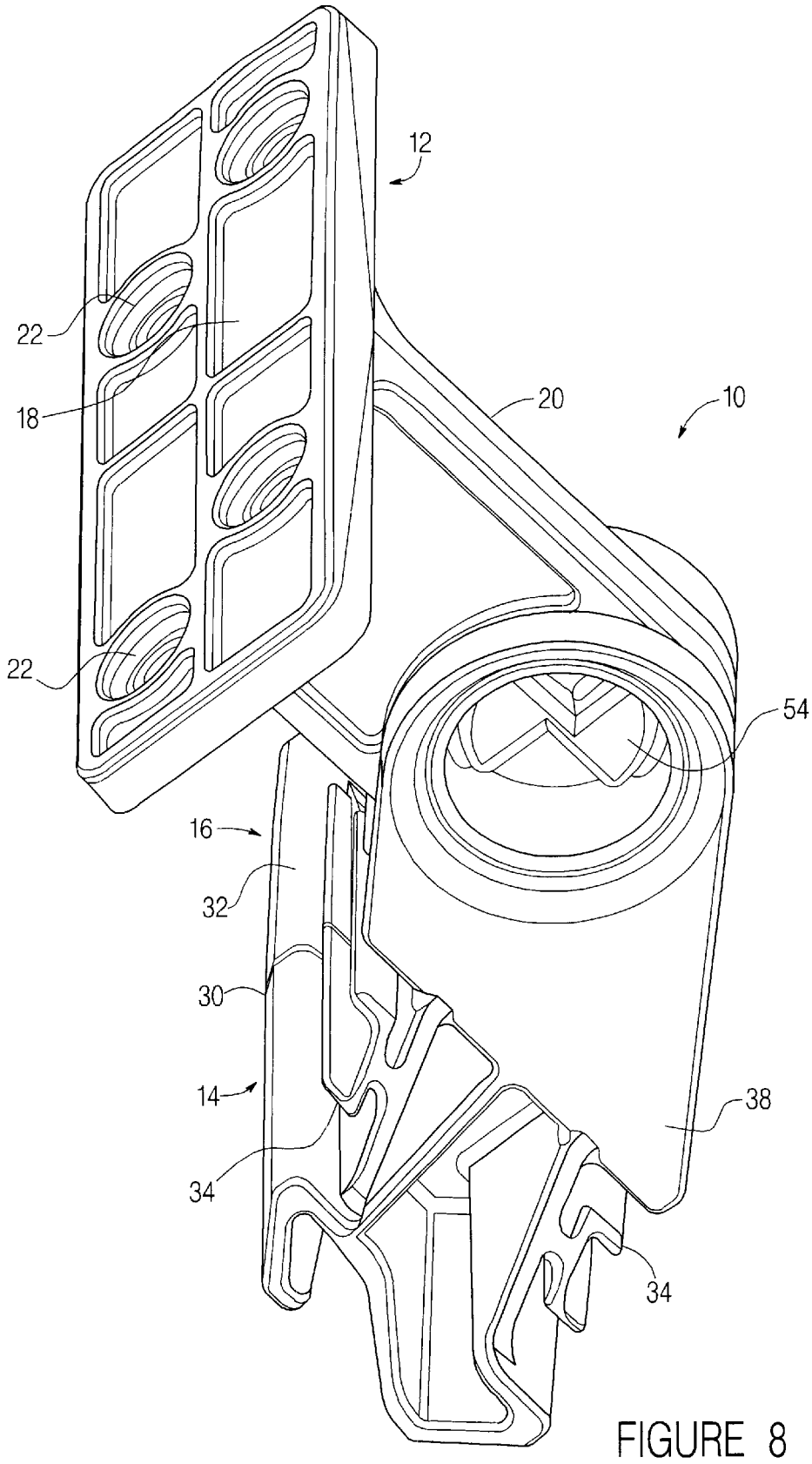
FIG. 8 is a perspective view of the hinge assembly of FIG. 1.

FIG. 8 illustrates the door "open" bottom view of hinge assembly 10 after rotating upper pivot mount 16 or lower pivot mount 14 are rotated into a fully assembled position. Prongs 54 of upper pivot mount 16 are shown disposed (e.g., "wedged") under a matching surface of lower pivot mount 14.

Figure 9:
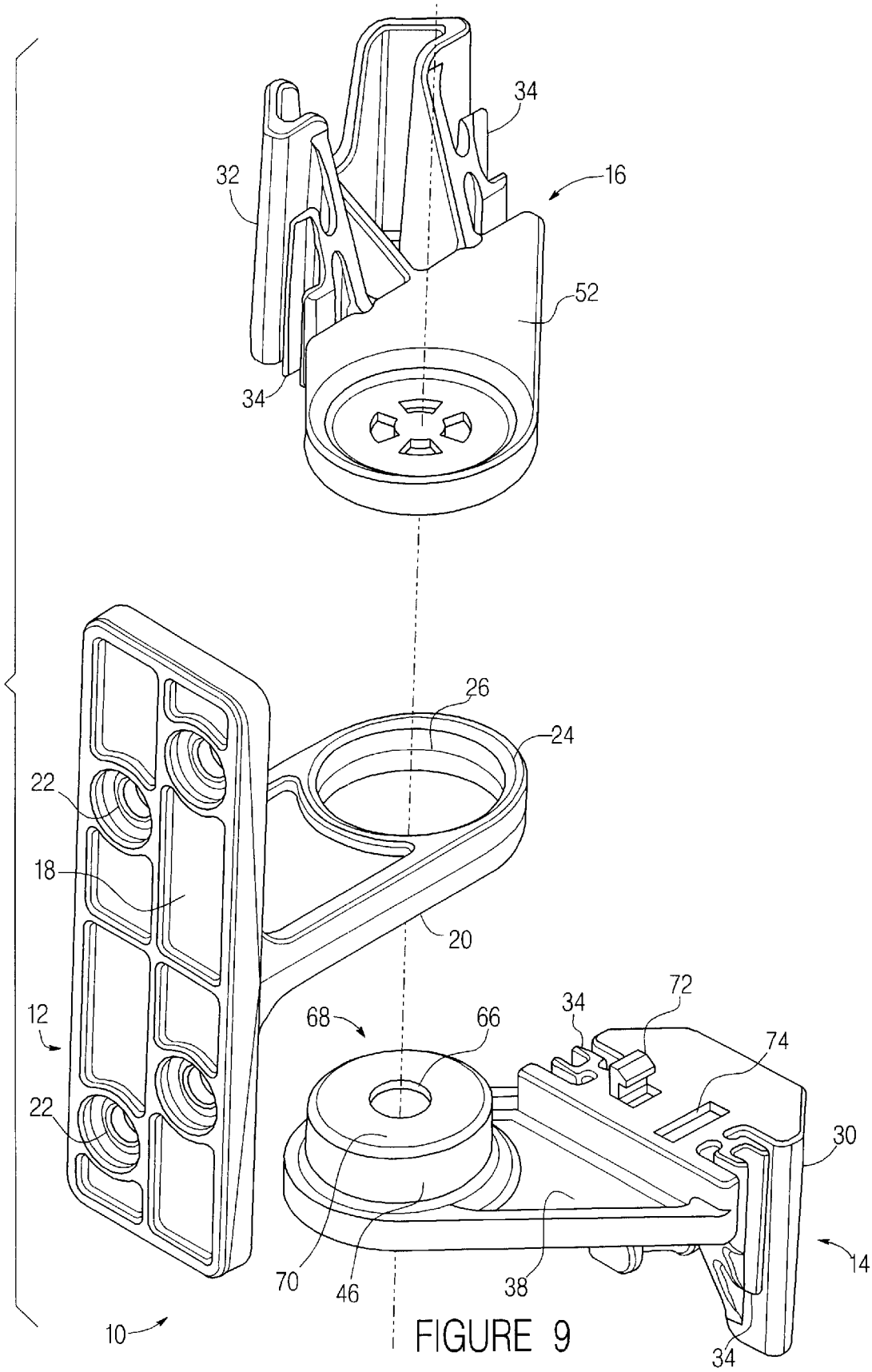
FIG. 9 is an exploded perspective view of a hinge assembly according to an alternative embodiment.
Figure 10:
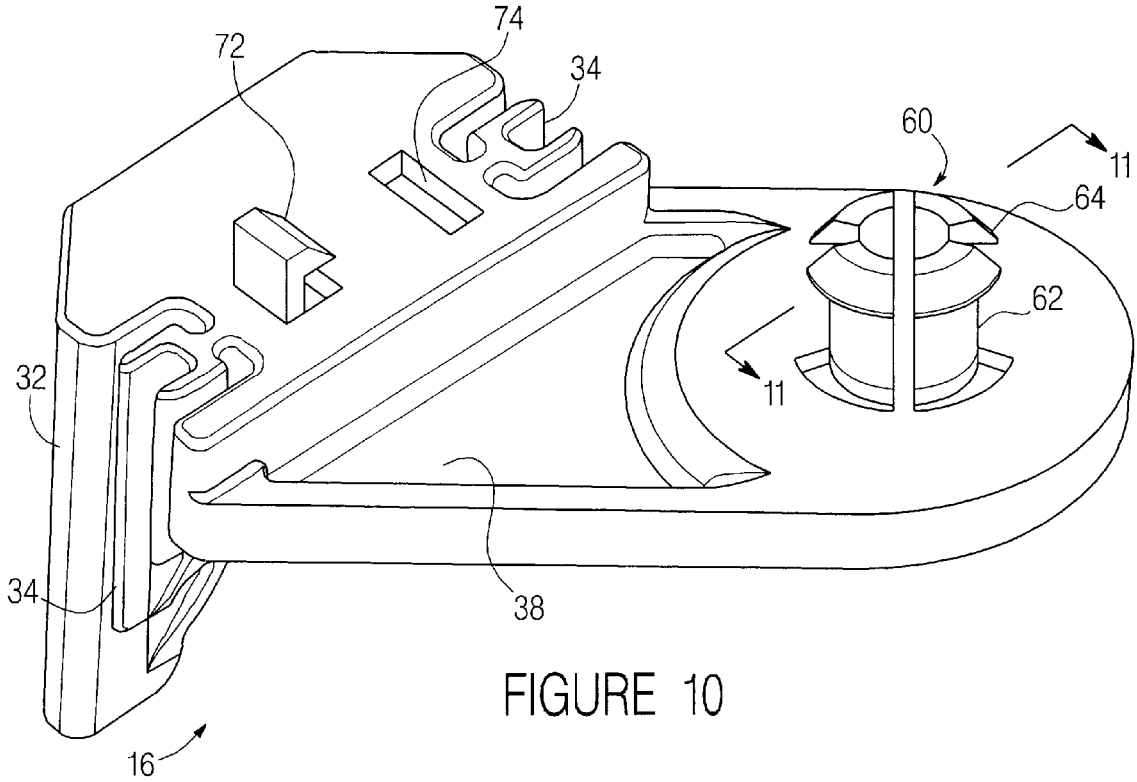
FIG. 10 is a perspective view of an upper pivot mount of the hinge assembly of FIG. 9.
Figure 11:
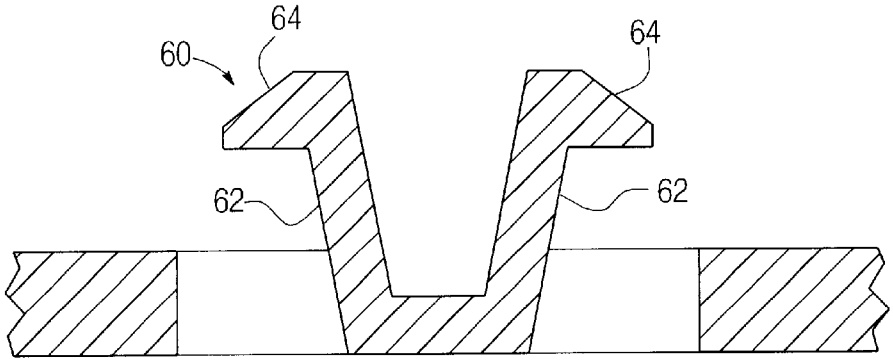
FIG. 11 is a cross-section view of the pivot interface of FIG. 10.

According to an alternative embodiment shown in FIGS. 9–11, the interlocking interface has a snap-fit engagement wherein prongs 60 include a shaft 62 and a ramped member 64. Shaft 62 is configured to flex or deflect as ramped member 64 is inserted into an aperture 66 in cylinder 68. As ramped member 64 is inserted past the upper wall 70 of cylinder 68, it resumes its static (unflexed) position so that cylinder 70 is captured by prongs 60. A connector (shown as a "snap-fit" member 72 and an aperture 74 are located on lower and upper interface members 30, 32. Prongs 60 and snap-fit member 72 are configured to engage apertures 66, 74 and provide a secure coupling.

It is also important to note that the construction and arrangement of the elements of the hinge assembly as shown in the preferred and other exemplary embodiments are illustrative only. Although only a few embodiments of the present invention have been described in detail in this disclosure, those skilled in the art who review this disclosure will readily appreciate that many modifications are possible (e.g., variations in sizes, dimensions, structures, shapes and proportions of the various elements, values of parameters, mounting arrangements, materials, colors, orientations, etc.) without materially departing from the novel teachings and advantages of the subject matter recited in the claims. For example, the interlocking interface of the pivot mounts may be any of a variety of techniques (e.g., snap-fit, rotational interference, fastened thermal, riveted, adhesion, welded, ultrasonic welded, etc., to name a few). Accordingly, all such modifications are intended to be included within the scope of the present invention as defined in the appended claims. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and/or omissions may be made in the design, operating conditions and arrangement of the preferred and other exemplary embodiments without departing from the spirit of the present invention as expressed in the appended claims.

What is claimed is:

1. A hinge assembly for a storage enclosure including a wall and a panel hingedly coupled to the wall, the hinge assembly comprising:

a base including a pivot member;

a pair of pivot mounts including a male/female interface;

wherein the male/female interface is configured to connect the pair of pivot mounts to each other and to operatively couple the pivot mounts to the pivot member and includes a pair of prongs in one pivot mount that engage a pair of slots in the other pivot mount.

2. The hinge assembly of claim 1 wherein a pivot axis is positioned in-line with an outside surface of the door and an edge of the hinge assembly.

3. The hinge assembly of claim 1 wherein bearing surfaces on the pivot member and the pivot mounts engage to provide rotation.

4. The hinge assembly of claim 1 wherein the pivot member includes a ring that is captured by the pair of pivot mounts when connected to each other.

5. The hinge assembly of claim 1 wherein the base is mounted to the panel and the pair of pivot mounts are mounted to the wall.

6. The hinge assembly of claim 1 wherein one of the pivot mounts includes a groove, and the other pivot mount includes a ramped lug that engages the groove in a snap-in engagement to provide resistance to movement.

7. A hinge assembly for a storage enclosure including a wall and a panel hingedly coupled to the wall, the hinge assembly comprising:

a base including a ring;

a first pivot mount including one or more slots defined by an upper wall;

a second pivot mount including one or more retaining members that engage the slots of the first pivot mount.

8. The hinge assembly of claim 7 wherein one of the first pivot mount and the second pivot mount includes a protruding ramped lug on the top base surface, and the other of the first pivot mount and the second pivot mount includes a slot on the bottom base surface so that engagement of the slot and the ramped lug provides resistance to movement.

9. The hinge assembly of claim 8 wherein the lug and slot couple in a snap-fit engagement.

10. The hinge assembly of claim 7 wherein the ring includes an inner bearing surface and one of the first and second mounts includes an outer bearing surface that moves against the inner bearing surface when the panel is rotated relative to the wall.

11. The hinge assembly of claim 7 wherein the retaining members include hook members that captured the upper wall when the first and second pivot ring are aligned.

12. The hinge assembly of claim 11 wherein the hook members couple to the upper wall in a snap-fit engagement.

13. The hinge assembly of claim 11 wherein the hook members couple to the upper wall in an interference-fit engagement.

14. The hinge assembly of claim 7, further including a pivot axis configured to allow approximately 180° of rotation of the base relative to the first and second pivot mounts.

15. A storage enclosure engagement comprising:

a wall;

a door hingedly coupled to the wall;

a hinge assembly including a base coupled to the door, and a first and second pivot mount coupled to the wall, the first pivot mount including an upper wall defining one or more slots, and the second pivot mount including one or more retaining members configured to engage the slots of the first pivot mount;

wherein the first and second pivot mount couple to the base by the engagement of the retaining members of the slots.

16. The storage enclosure of claim 15 wherein the pivot axis is configured to allow approximately 180° of rotation.

17. The storage enclosure of claim 15 wherein first pivot mount is a lower pivot mount and the second pivot mount is an upper pivot mount.

18. The storage enclosure of claim 15 wherein the retaining members are ramped hook members that engage an upper wall on the of the first pivot mount in an interference-fit engagement.

19. The storage enclosure of claim 15 wherein one of the first pivot mount and the second pivot mount includes a protruding ramped lug on the top base surface, and the other of the first pivot mount and the second pivot mount includes a slot on the bottom base surface to receive the ramped lug.

* * * * *

UNITED STATES PATENT AND TRADEMARK OFFICE

CERTIFICATE OF CORRECTION

PATENT NO. : 6,681,447 B2
DATED : January 27, 2004
INVENTOR(S) : David A. Houk, Jr. et al.

It is certified that error appears in the above-identified patent and that said Letters Patent is hereby corrected as shown below:

Title page,
Item [57], ABSTRACT,
Line 9, please replace "One pivot mounts" with -- One pivot mount --.

Column 6,
Lines 56-57, please replace "to the pivot member" with -- to the pivot member, --.

Signed and Sealed this

Fifteenth Day of June, 2004

JON W. DUDAS
*Acting Director of the United States Patent and Trademark Office*